US006029554A

United States Patent [19]

Boot et al.

[11] Patent Number: 6,029,554

[45] **Date of Patent: *Feb. 29, 2000**

[54] APPARATUS FOR TRIMMING A FABRIC PANEL

[75] Inventors: Jeffrey T. Boot, Sudbury; Matthew D. Bouche, Chelmsford, both of Mass.; James R. Mazur, Londonderry, N.H.

[73] Assignee: Design Technology Corporation, Billerica, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/844,689

[22] Filed: Apr. 18, 1997

Related U.S. Application Data

[63] Continuation of application No. 08/332,872, Nov. 1, 1994, abandoned.

[51] Int. Cl.[7] ..... B26D 7/18; D05B 37/04

[52] U.S. Cl. ..... 83/402; 83/100; 83/411.7; 83/412; 83/452; 83/939; 83/485; 83/495; 112/287; 112/DIG. 2; 269/21

[58] Field of Search ..... 83/100, 418, 451, 83/452, 459, 936, 937, 939, 113, 175, 402, 409, 410.7, 410.8, 411.3, 411.4, 411.5, 411.7, 412, 485, 439, 495; 112/122, 122.3, 287, DIG. 1, DIG. 2; 269/21

[56] References Cited

U.S. PATENT DOCUMENTS

| | | | |
|---|---|---|---|
| 3,144,216 | 8/1964 | Billingsley | 83/100 X |
| 3,465,625 | 9/1969 | Daly | 83/100 X |
| 3,602,172 | 8/1971 | Bray | 112/DIG. 1 |
| 3,669,047 | 6/1972 | Hedegaard | 83/175 |
| 3,795,164 | 3/1974 | Schneider | 83/100 X |
| 3,880,047 | 4/1975 | Dosier | 83/451 X |
| 4,069,729 | 1/1978 | Kuts | 83/939 X |
| 4,127,075 | 11/1978 | Asamski, Jr. et al. | 112/122 X |
| 4,214,495 | 7/1980 | Coburn | 83/425.4 |
| 4,382,728 | 5/1983 | Anderson et al. | 83/940 X |
| 4,392,646 | 7/1983 | Costigan | 83/937 X |
| 4,528,878 | 7/1985 | Gerber | 83/100 X |
| 4,549,452 | 10/1985 | Jobst | 83/100 X |
| 4,997,329 | 3/1991 | Hanamoto et al. | 83/402 |
| 5,386,751 | 2/1995 | Dylla et al. | 83/18 |

*Primary Examiner*—Rinaldi I. Rada
*Assistant Examiner*—Boyer Ashley
*Attorney, Agent, or Firm*—Rhodes & Mason, PLLC

[57] ABSTRACT

An apparatus for trimming the edges of a fabric panel. The apparatus includes a holding fixture for holding the panel such that the edges to be trimmed hang freely in the holding fixture. A trimming apparatus is insertable into the holding fixture for trimming the edges of the panels together while the panels are held in the holding fixture. The trimming apparatus includes a frame having a movable slide and at least one trimming assembly attached to the slide. A fixture drive engages the holding fixture holding the edges of the panels to be trimmed and repositions the holding fixture prior to trimming the edges of the panel.

9 Claims, 8 Drawing Sheets

APPARATUS FOR TRIMMING A FABRIC PANEL

This application is a continuation of application Ser. No. 08/332,872 filed Nov. 1, 1994 now abandoned.

BACKGROUND OF THE INVENTION (1) Field of the Invention

The present invention relates generally to automated manufacturing systems and, more particularly, to an apparatus for trimming a fabric panel for manufacturing a men's brief or the like.

(2) Description of the Prior Art

The manufacture of textile clothing articles such as briefs, tee-shirts and outer garments has resisted automation. This is due largely because of the difficulty in accurately positioning so called "soft" materials. For example, the knitted material commonly used in briefs and tee-shirts may wrinkle, stick to one another and stretch significantly when handled.

One technique which has been somewhat successful has been the introduction of fiber optic edge detectors. Such detectors, when attached to a sewing machine and guide means can allow some automation of common sewing operations such as binding an edge of a precut fabric piece. However, such operations still require the use of a skilled operator to feed the fabric piece to the sewing machine and usually carry out only one sewing operation at a time.

One area of particular importance is the accurate determination of the edge of a cut fabric panel. This is particularly difficult since soft goods tend to distort after cutting and following handling. However, it has surprisingly been discovered that these problems can be avoided if the fabric panel is first positioned and then cut to its final dimensions.

Thus, there remains a need for an apparatus for trimming a fabric panel for manufacturing a men's brief or the like which can be carried out completely automatically without the need for a skilled operator.

SUMMARY OF THE INVENTION

The present invention is directed to an apparatus for trimming the edges of a fabric panel for manufacturing a men's brief or the like. The apparatus includes a holding fixture for holding the panel such that the edges to be trimmed hang freely in the holding fixture. A trimming apparatus is insertable into the holding fixture for trimming the edges of the panels together while the panels are held in the holding fixture. The trimming apparatus includes a frame having a movable slide and at least one trimming assembly attached to the slide. A fixture drive engages the holding fixture holding the edges of the panels to be trimmed and repositions the holding fixture prior to trimming the edges of the panel.

Accordingly, one aspect of the present invention is to provide an apparatus for trimming a fabric panel along the edges thereof. The apparatus includes: (a) a holding fixture for holding the panel such that the edges to be trimmed hang freely in the holding fixture; and (b) a trimming apparatus insertable into the holding fixture for trimming the edges of the panels while the panels are held in the holding fixture.

Another aspect of the present invention is to provide a fabric trimming apparatus. The apparatus includes: (a) a frame having a movable slide; and (b) at least one trimming assembly attached to the slide.

Still another aspect of the present invention is to provide an apparatus for trimming a fabric panel along the edges thereof. The apparatus includes: (a) a holding fixture for holding the panel such that the edges to be trimmed hang freely in the holding fixture; (b) a trimming apparatus insertable into the holding fixture for trimming the edges of the panels together while the panels are held in the holding fixture, the trimming apparatus including (i) a frame having a movable slide; and (ii) at least one trimming assembly attached to the slide; and (c) a fixture drive for engaging the holding fixture holding the edges of the panels to be trimmed and repositioning the holding fixture prior to trimming the edges of the panel.

These and other aspects of the present invention will become apparent to those skilled in the art after a reading of the following description of the preferred embodiment when considered with the drawings.

DESCRIPTION OF THE PREFERRED EMBODIMENTS

Figure 1:
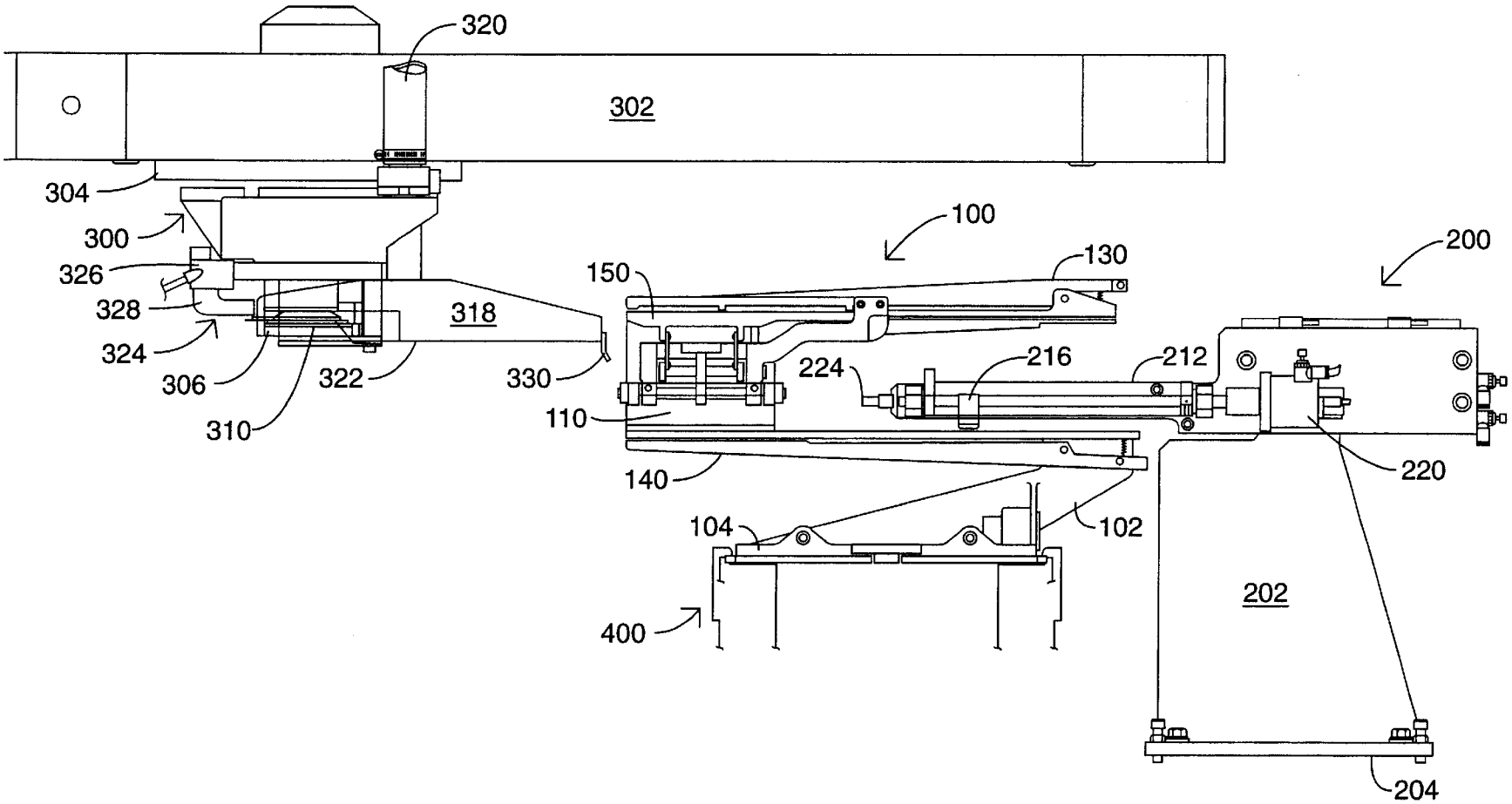
FIG. 1 is a side elevation view of a panel trimming machine constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a panel trimming machine constructed according to the present invention, generally designated 10, is shown. The panel trimming machine 10 comprises a holding fixture 100 for holding the panels which are being trimmed, a fixture drive 200 for engaging the holding fixture and disposing the edges of the fabric panel, and a trimming apparatus 300 for trimming the edges of the panels together.

The panel trimming machine 10 is designed to trim the edges of a fabric panel. More particularly, the panel trimming machine 10 of the present invention is designed to trim the back panel of a pair of men's briefs prior to joining the back panel and front panel together. The back panel includes a top edge, a bottom edge, side edges and leg cuts. The front panel has a generally rectangular configuration and includes a top edge, a bottom edge, and two side edges. The front panel consists of two plys and each ply of the front panel includes an arcuate fly cut. According to the present invention the side edges of the back panel are trimmed with respect to the side edges of the top panel prior to the panels being sewn together. Although the present invention is designed particularly for use in the manufacture of men's underwear, it can also be adapted for use with other types of garments.

Figure 2:
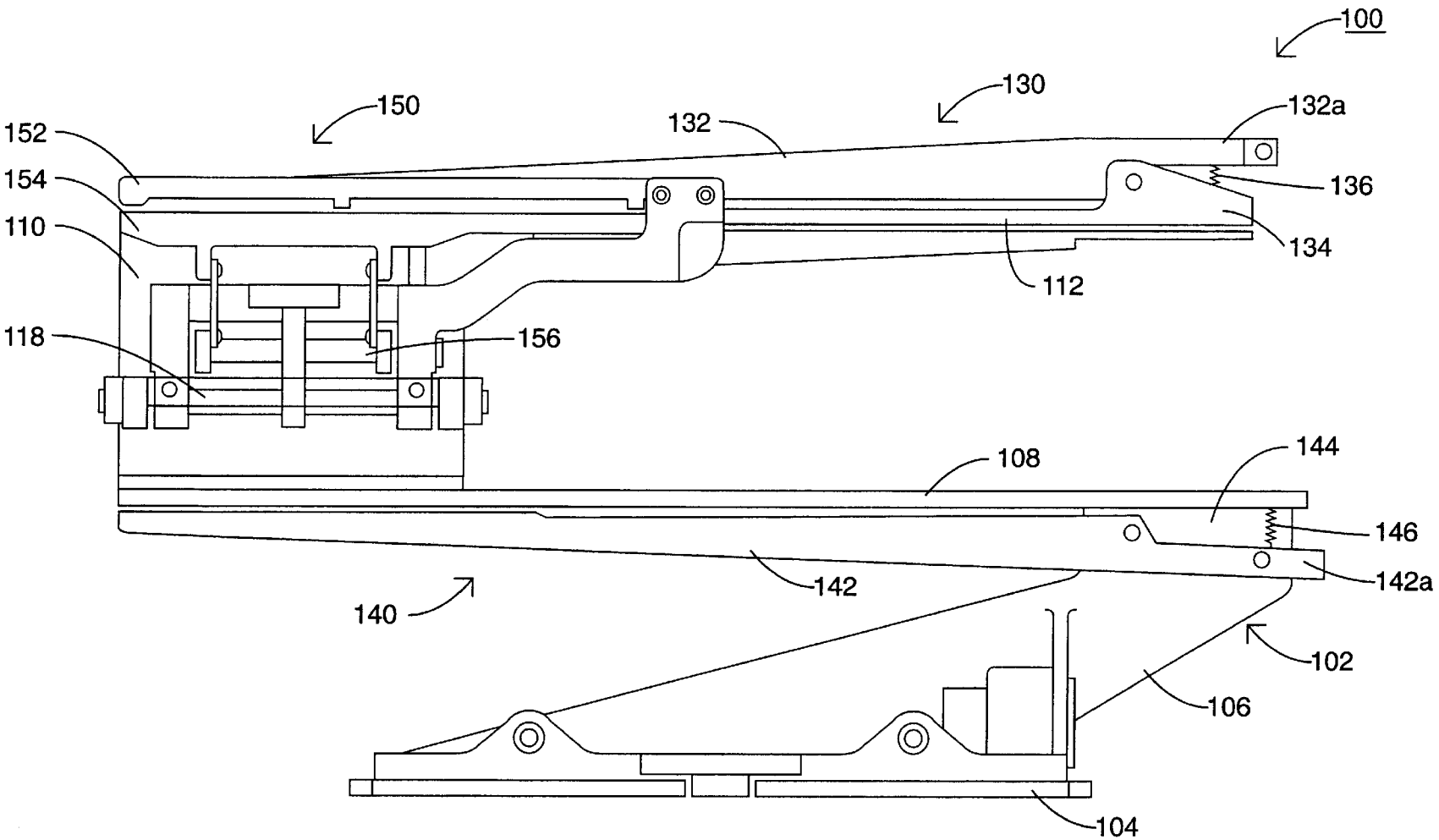
FIG. 2 is a side elevation view of the holding fixture.
Figure 3:
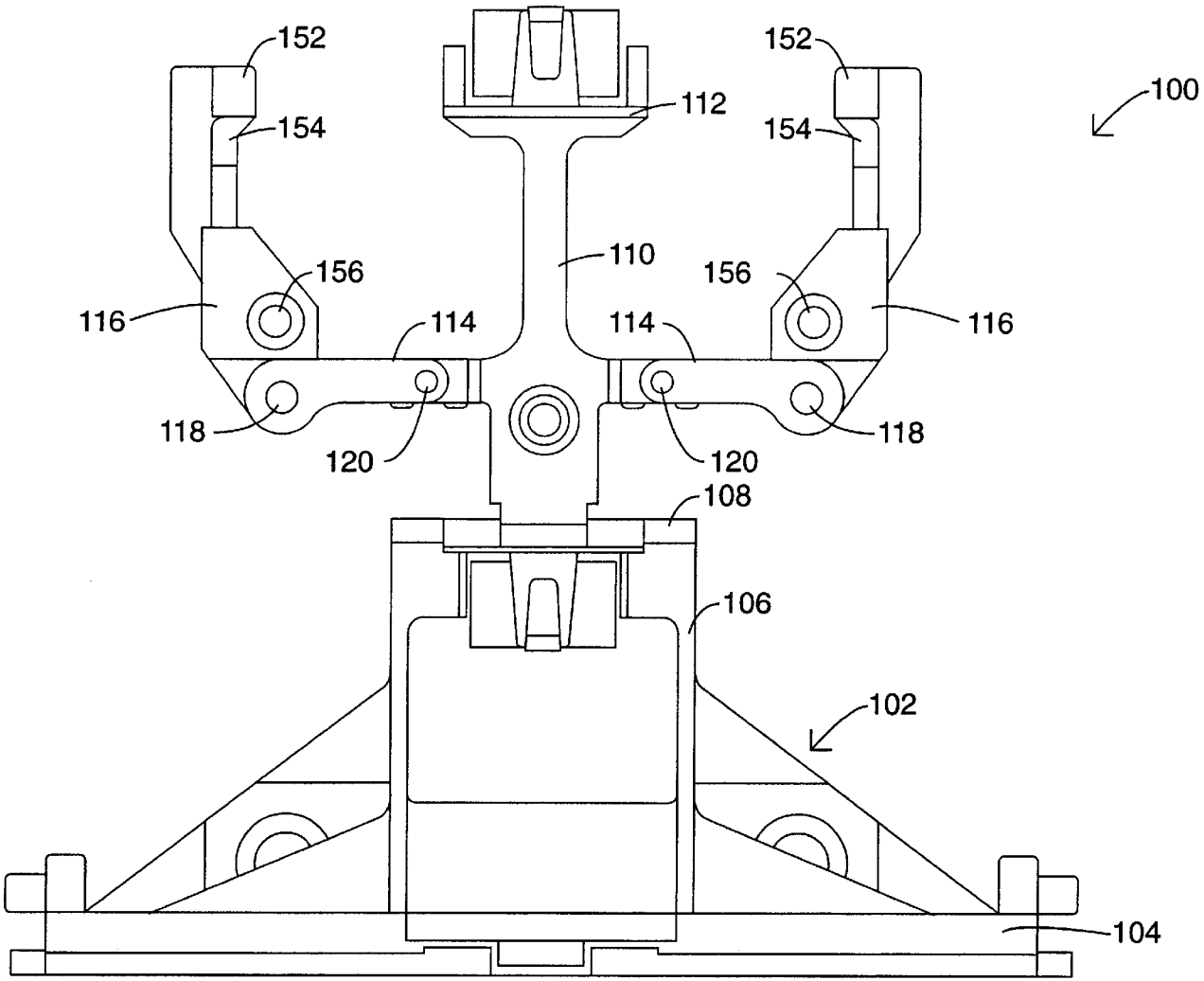
FIG. 3 is an end view of the holding fixture.

Prior to sewing, the back panel and front panel are held by a holding fixture 100. As best seen in FIGS. 2–3, the holding fixture 100 includes a support structure 102, a top clamp 130, a bottom clamp 140, and two side clamps 150. The support structure 102 includes a generally flat base 104. A lower support member 106 extends upwardly from the base 104 and supports an elongated clamping plate 108 from one end thereof. An upper support member 110 is mounted on top of the lower clamping plate 108 at the opposite end. The upper support member 110 supports an upper clamping plate 112. Support arms 114 are rigidly fixed to the upper support member 110 and extend outwardly therefrom. A pivot member 116 is connected to the outer end of each support arm 114 by a pivot rod 118. The pivot member 116 is locked in a raised position by a detent 120. When the pivot rod 118 is pushed, the detent 120 releases the pivot member 116. The pivot member can then rotate to a lowered position.

The top clamp 130 includes a clamping arm 132 which is pivotally mounted within a yoke 134. The clamping arm 132 is biased into engagement with the upper clamping plate 112 by a spring 136. The spring 136 engages an end portion 132*a* of the clamping arm 132. When the end portion 132*a* is pressed against the resistance of the spring 136, the clamping arm 132 is raised off the clamping plate 112. While the clamping arm 132 is in the raised position, the front panel is inserted between the clamping plate 112 and the clamping arm 132 such that the side edges of the front panel hang freely from each side of the clamping plate 112.

The bottom clamp 140 is similar in construction to the top clamp 130. The bottom clamp includes a clamping arm 142 which is pivotally mounted to a yoke 144. The clamping arm 142 is biased by a spring 146 into contact with the lower clamping plate 108. When the end portion 142 of the clamping arm is pressed against the resistance of the spring 146, the clamping arm 142*a* is lowered. When the clamping arm 142 is lowered, the back panel is inserted into the bottom clamp such that the center portion of the back panel is held between the clamping arm 142 and clamping plate 108.

The end portions (see e.g. FIG. 8A) of the back panel are held by the side clamps 150. The side clamps 150 include an upper jaw 152 which is fixedly secured to the pivot member 116. A lower jaw 154 is pivotally mounted to the pivot member 116. The lower jaw 154 is connected to a control rod 156 by linkages 158. When the control rod 156 is rotated, the lower jaw 154 is drawn downward away from the upper jaw 152. The end portions of the back panels are then inserted into respective side clamps 154 such that the edges hang downwardly in the holding fixture 100.

When the side clamps 150 are in the raised position, the side clamps 150 are level with the top clamp 130. The side clamps 150 are spaced sufficiently on either side of the top clamp 130 so as to allow the trimming apparatus 300 as hereinafter described to travel between the top clamp 130 and the side clamp 150.

Figure 4:
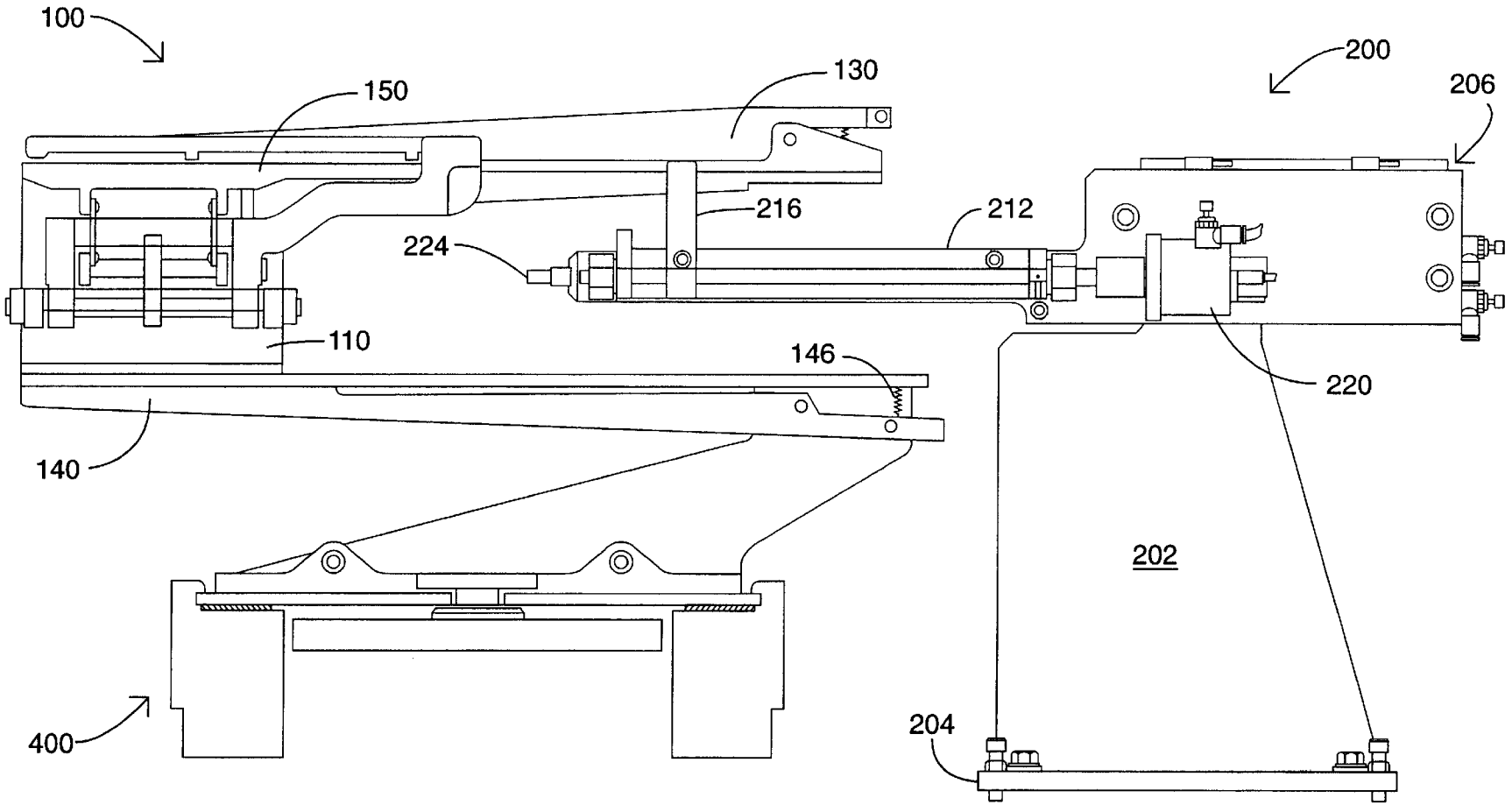
FIG. 4 is a side elevation view of the fixture drive.
Figure 5:
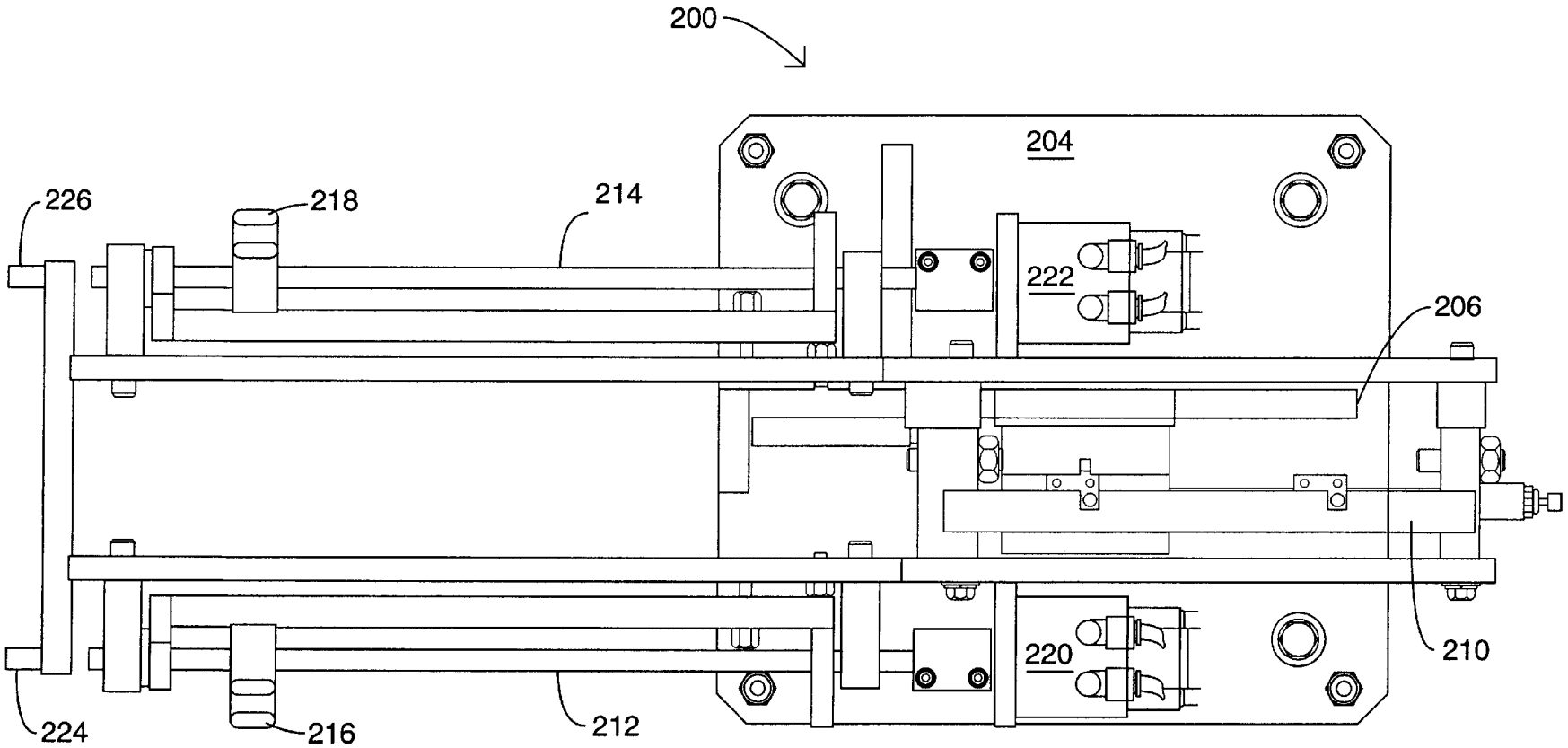
FIG. 5 is a plan view of the fixture drive.
Figure 6:
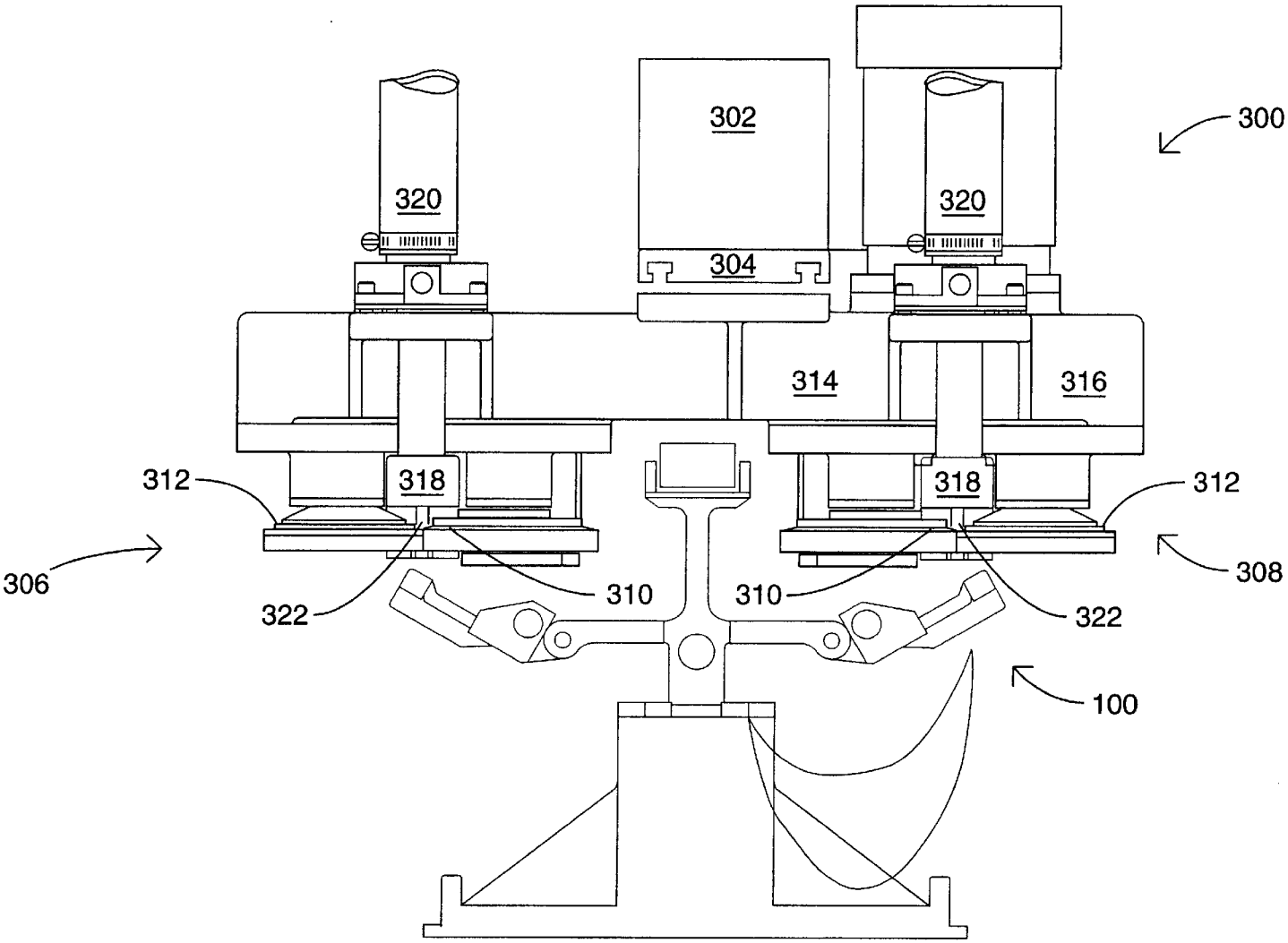
FIG. 6 is a side elevation view of the trimming apparatus.

Referring now to FIGS. 4–5, the fixture drive 200 is shown. Fixture drive 200 includes a frame 202 attached to a base 204. A slide 206 is attached to the end of the frame opposite the base. Slide 206 includes a pneumatic actuator 210 for moving the slide 206 with respect to the holding fixture 100. Fixture drive 200 includes a pair of rotating actuator arms 212, 214. Each rotating actuator arm 212, 214 includes engagement means 216, 218 for engaging the side clamps 150 of the holding fixture. Rotating actuator arms 212, 214 are driven by pneumatic actuators 220, 222 between a first vertical position and a second position about 30° from vertical as will be best understood later. In the preferred embodiment, rotating actuator arms 212, 214 also include detent actuators 224, 226 for engaging a release of control rod 156. In operation, pneumatic actuator 210 moves slide 206 forward to engage rotating actuator arms 212, 214 with holding fixture 100. Rotating actuators 220, 222 are then actuated and side clamps 150 are rotated downward to an angle of about 30° from vertical. At this point, trimmer apparatus 300 is engaged.

Figure 7:
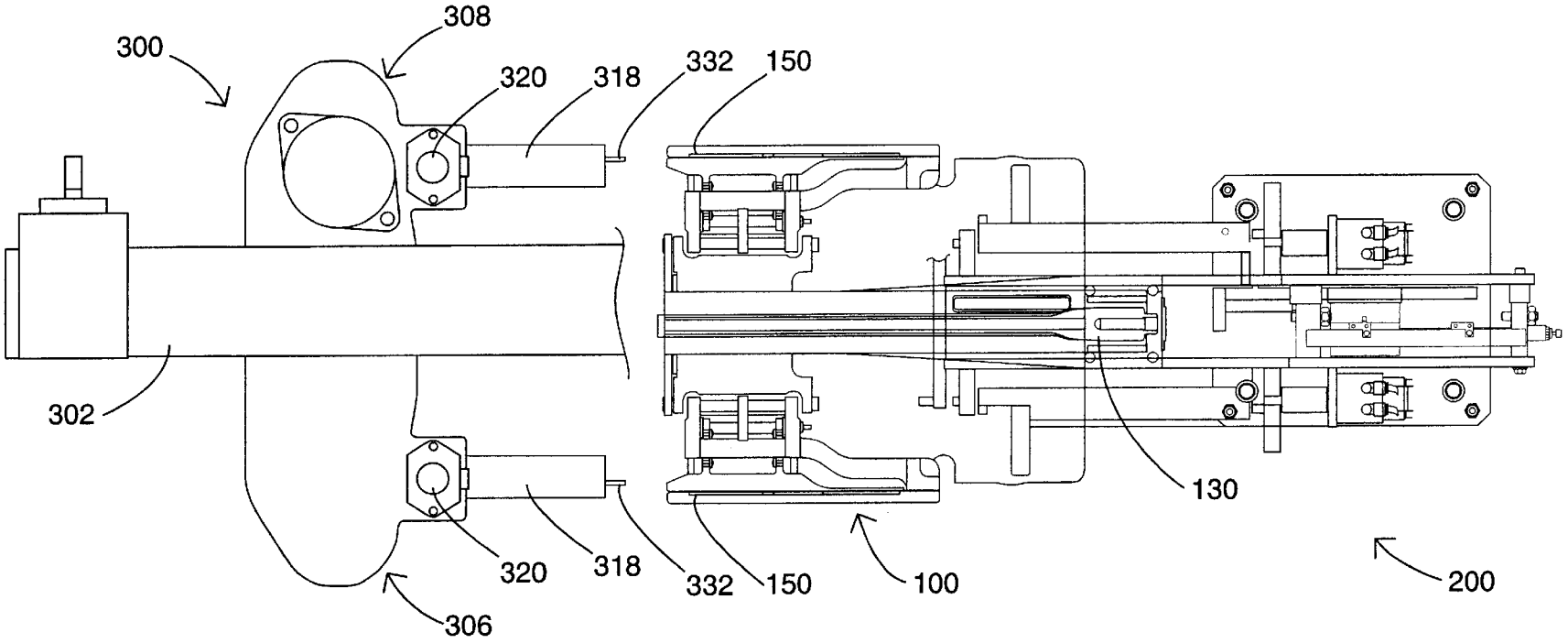
FIG. 7 is a top plan view of the trimming apparatus.

As can be seen in FIGS. 1 and 7, trimming apparatus 300 includes a frame 302 having a slide 304. A pair of trimming assemblies 306, 308 are attached to the slide 304. Each trimming assembly includes a circular blade 310 and a matching anvil 312. Circular blade 310 and anvil 312 are driven by drive means 314, 316 respectfully. An elongated vacuum chamber is located adjacent to the upper surface of trimming assemblies 306 and 308. Vacuum chamber 318 includes a source of vacuum 320 and an elongated downwardly-extending slot 322. A scrap removing assembly 324 is located rearwardly of the vacuum chamber 318. Scrap removing assembly 324 includes a source of vacuum 326 and a scrap tube 328. In the preferred embodiment, fingers 330, 332 are located on the end of elongated vacuum chamber 318 adjacent to fixture 100 for lifting the portion of the back panel held by side clamps 150 in order that they may be correctly positioned to be received by vacuum chamber 318 and trimming assemblies 306, 308.

In operation, trimmer assemblies 306, 308 are moved from a first position away from holding fixture 100 into a second position whereby fingers 330, 332 engage the edges of the fabric panel and side clamps 150 and lift the edges of the panel whereby elongated vacuum chamber 318 further lifts the edges of the vacuum chamber of the fabric such that trimming assemblies 306, 308 can engage and trim the edge of the fabric panel. After trimming, the trimming assemblies 306, 308 are retracted back into the first position away from the holding fixture.

Figure 8A:
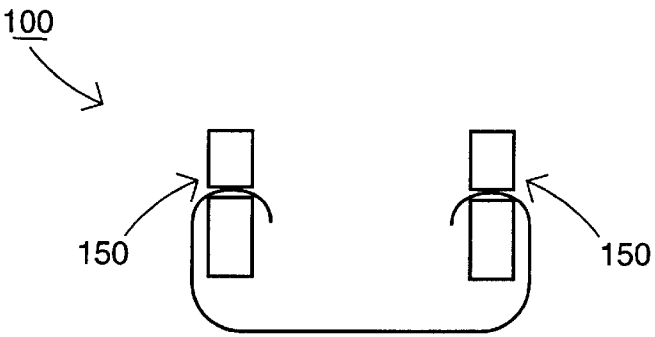
FIGS. 8A–8D are schematic diagrams illustrating the operation of the present invention.
Figure 8B:
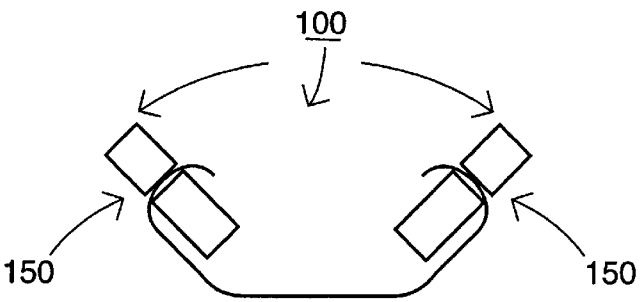
Figure 8C:
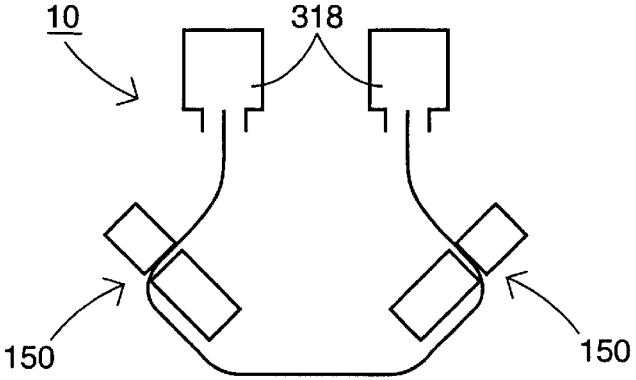
Figure 8D:
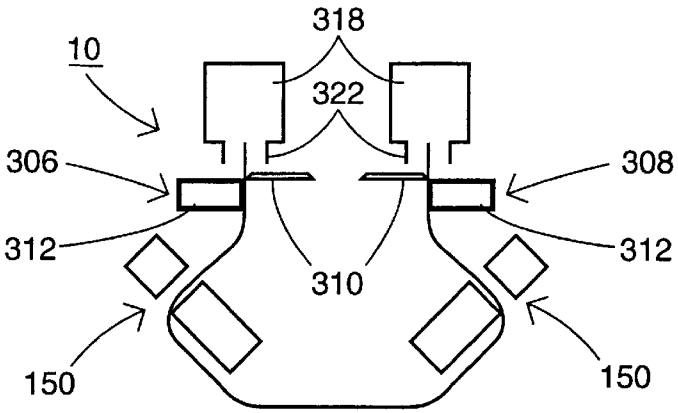

The cooperation of the holding fixture, trimmer assemblies and fixture drive of the present invention can best be understood by referring to FIGS. 8A–8D which is a schematic representation of the panel trimming machine 10 of the present invention. First, the back panel and front panel are loaded into the holding fixture. The panels can be manually inserted into the holding fixture 100 or can be inserted by automatic means. As can be seen in FIG. 8A, fabric panel is held by side clamps 150 in a generally vertical position with the edges of the fabric extending downward and inward with respect to the side clamps. The holding fixture 100 is then conveyed by means of a conveyor 400 to the panel trimming machine 10. Fixture drive 200 engages the side clamps and rotates them outwardly at an angle of about 30° (8B). Next trimmer assembly 300 is actuated and moves forward with respect to fixture 100. The movement of air into the vacuum chamber 318 causes the edges of the fabric to be lifted in a generally vertical orientation (8C). At this point, circular blades 310 and anvil 312 of the trimmer assemblies 306, 308 engage and trim the edge of the fabric panel and the scrap is removed into the scrap removal assembly 324 (8D). In the preferred embodiment, the trimmer assemblies are underfed with respect to the cutting speed of the blades in order to maintain tension along the fabric edge during trimming. After the trimming operation, the trimming apparatus moves away from the holding fixture 100 and the cycle is repeated.

Based on the foregoing, it is apparent that the panel trimming machine 10 provides an automated mechanism for trimming the back panel of men's underwear prior to joining the front and back panels together. The panel trimming machine 10 of the present invention reduces labor costs associated with the production of men's underwear. Further, the panel trimming machine 10 reduces the number of defects as compared to manual trimming operations.

Certain modifications and improvements will occur to those skilled in the art upon a reading of the foregoing description. By way of example, while a rotating blade and anvil has been used for trimming the edges of the panel, other types of cutting means could be used such as knives or guillotine blades. Also, while pneumatic actuators have been generally used, servo-motor actuators could usually be substituted. It should be understood that all such modifications and improvements have been deleted herein for the sake of conciseness and readability but are properly within the scope of the following claims.

We claim:

1. A fabric trimming apparatus, said apparatus comprising:

(a) a frame having a movable slide and a holding fixture having a holding surface for holding a fabric panel;

(b) at least one trimming assembly attached to the slide, said trimming assembly including a circular blade, a matching anvil, and a drive means connected to said circular blade and said anvil; and (c) means for aligning said fabric edges prior to trimming, said means including an edge lifter with a vacuum chamber for lifting freely hanging edges of a fabric panel away from said holding fixture and towards said vacuum chamber with a vacuum during trimming with said at least one trimming assembly, said edge lifter being generally linearly aligned with said surface of said holding fixture and perpendicularly aligned with said circular blade; wherein said edge lifter lifts the freely hanging edges into alignment with a portion of the fabric panel on the holding fixture surface, wherein said fabric is first clamped in said holding fixture and then aligning said edges with said vacuum chamber prior to trimming.

2. The fabric trimmer according to claim 1, wherein said vacuum chamber of said edge lifter further includes an elongated chamber located adjacent to an upper surface of said at least one trimming assembly for receiving the freely hanging edges of the fabric panel.

3. The fabric trimmer according to claim 2, wherein said chamber includes an elongated downwardly-extending slot.

4. The fabric trimmer according to claim 2, further including a scrap removing assembly located adjacent to said chamber.

5. The fabric trimmer according to claim 4, wherein said scrap removing assembly is coupled to said vacuum chamber and includes a scrap tube for removing scrap formed during edge trimming.

6. An apparatus for trimming a fabric panel along edges of said fabric panel, said apparatus comprising:

(a) a holding fixture having a surface for holding said panel such that the edges of said fabric panel hang freely in said holding fixture;

(b) an edge lifter with a vacuum chamber for lifting the freely hanging edges of said fabric panel away from said holding fixture and towards said vacuum chamber with a vacuum during trimming, said edge lifter being generally linearly aligned with said surface of said holding fixture wherein said edge lifter lifts the freely hanging edges into alignment with a portion of the fabric panel on the holding fixture surface;

(c) a trimming apparatus insertable into said holding fixture for trimming the freely hanging edges of said panels while said panel is held in said holding fixture and the freely hanging edges of said panels are lifted away from said holding fixture with said edge lifter, said trimming apparatus including (i) a frame having a movable slide; and (ii) at least one trimming assembly attached to the slide, said trimming assembly including a circular blade, said circular blade being perpendicularly aligned with said edge lifter; a matching anvil; and a drive means connected to said circular blade and said anvil; and (d) a fixture drive for engaging said holding fixture and repositioning said holding fixture prior to trimming the edges of said panel.

7. An apparatus for trimming a fabric panel along edges of said fabric panel, said apparatus comprising:

(a) a holding fixture having a surface for holding said panel such that the edges of said fabric panel hang freely in said holding fixture;

(b) a trimming apparatus adapted to be inserted into said holding fixture for trimming the edges of said panels together while said panel is held in said holding fixture, said trimming apparatus including (i) a frame having a movable slide; and (ii) at least one trimming assembly attached to the slide, said trimming assembly including a circular blade, a matching anvil, and a drive means connected to said circular blade and said anvil;

(c) a fixture drive for engaging said holding fixture and repositioning said holding fixture prior to trimming the edges of said panel; and (d) an elongated edge lifter having a vacuum chamber located adjacent to said trimming assembly, said vacuum chamber for lifting the freely hanging edges of said fabric panel away from said holding fixture and towards said vacuum chamber with a vacuum during trimming with said trimming apparatus, said edge lifter being generally linearly aligned with said surface of said holding fixture and perpendicularly aligned with said circular blade, wherein said edge lifter lifts the freely hanging edges into alignment with a portion of the fabric panel on the holding fixture surface.

8. The apparatus according to claim 7, further including a scrap removing assembly attached to said vacuum chamber for removing scrap formed during edge trimming.

9. The apparatus according to claim 7, further including a scrap removing assembly coupled to said vacuum chamber and a scrap tube for removing scrap formed during edge trimming.

* * * * *